United States Patent [19]

Fish

[11] 4,380,327

[45] Apr. 19, 1983

[54] SAFETY BARRIER

[76] Inventor: Robert E. Fish, 454 S. Dixie Hwy., Pompano Beach, Fla. 33060

[21] Appl. No.: 262,777

[22] Filed: May 11, 1981

[51] Int. Cl.[3] ..... E04N 17/16

[52] U.S. Cl. ..... 256/24; 256/73

[58] Field of Search ..... 256/23, 24, 25, 26, 256/27, 13, 52, 73; 273/298

[56] References Cited

U.S. PATENT DOCUMENTS

| | | | |
|---|---|---|---|
| 544,920 | 8/1895 | Kaufman | 256/23 |
| 3,273,862 | 9/1966 | Miller . | |
| 3,346,238 | 10/1967 | Dashio . | |
| 3,347,527 | 10/1967 | Andrews | 256/24 X |
| 3,913,889 | 10/1975 | Nugent et al. | 256/13 X |
| 4,083,535 | 4/1978 | Britt . | |
| 4,105,190 | 8/1978 | Curtis | 256/1 |

*Primary Examiner*—Richard J. Scanlan, Jr.
*Attorney, Agent, or Firm*—Malin & Haley

[57] ABSTRACT

A collapsible, durable, mildew proof safety barrier comprising a plurality of vertical support members which are supported in sleeves inserted within the ground, at least one flexible restraining panel connected between the vertical support members, a connecting device for connecting the restraining panel to each of the vertical support members, and a line or rope connected to the top of the panel. In the preferred embodiment the safety barrier is placed around the perimeter of a pool to prevent the unauthorized entrance into the pool. Because of the placement in a potential humid area, the preferred embodiment provides that the vertical support members and the panel fasteners are made of aluminum; the restraining panel is made of polycoated nylon to provide a longer life for the safety barrier. When the fence is not needed, it is simply removed by taking the vertical support members from the sleeves and folding the fence into a storable position.

4 Claims, 6 Drawing Figures

SAFETY BARRIER

BACKGROUND OF THE INVENTION

The present invention relates to safety barriers and more particularly to a light weight, water proof safety barrier which can be easily folded for storage when not in use, to prevent children from reaching a swimming pool or other dangerous area.

Often light weight barriers are not sturdy, once installed, due to the particular construction. In the past, there have been various fences designed for ease of placement in the functional position and also for removal to a compact storage position. The device shown in U.S. Pat. No. 3,347,527 illustrates such a fence. The lightweight snow fence includes a plurality of flexible strips (with chicken wire therebetween) connected on either end by a retaining bracket, which is in turn connectable to a fence post. The fence post is further supported by additional support members which have one end imbedded in the ground. When not in use, the end brackets can be removed from the fence posts and the fence portion rolled up for storage until the fence is reinstalled for the next winter season.

Other patents of interest are U.S. Pat. No. 4,083,535; U.S. Pat. No. 3,273,862; and U.S. Pat. No. 3,346,238.

The present invention improves upon the prior art by providing a lightweight, waterproof fence (useful in a humid environment around a swimming pool) which can easily be handled (installed or removed) by one person and can be folded into a storage position when not in use. The lightweight poles can be left attached to the restraining panels and do not have to be separately stored. Although lightweight, the present invention is extremely sturdy when in use.

SUMMARY OF THE INVENTION

According to the present invention, a new and improved lightweight, waterproof safety barrier is provided. The safety barrier comprises a plurality of lightweight rigid vertical support members which may be inserted into sleeves in the ground to hold the safety barrier in an upright position, at least one continuous mesh like, plastic restraining panel connected to the vertical support members, connecting brackets for holding the panel to the support members, and a flexible line mounted along the top of the panel.

In the preferred embodiment, the vertical support members are made of aluminum and are essentially hollow. The continuous restraining panel is a polycoated nylon mesh having top and bottom edges that include reinforcing strips of plastic coupled thereto integrally. The panel is attached to each vertical member by plastic strips having arcuate shaped edge and screws that are mounted therethrough that connect the strip to the vertical support member engaging the mesh in between the strip and the pole. The strip can also be used at the end of each fence segment as a terminal strip for connecting the end of the panel to the pole.

The top of each panel includes a reinforced plastic strip that is hollow and has a flexible plastic type of line or cord disposed therethrough which improves the vertical and horizontal support of each panel between each support member. The line or rope also enhances the sturdiness of the barrier preventing penetration therethrough.

It is therefore an object of this invention to provide a new and improved lightweight, waterproof safety barrier which can be easily installed or removed by one person.

It is another object of this invention to provide a lightweight, humidity proof safety barrier for use around swimming pools, canals or other bodies of water, the improved barrier being rust proof.

It is yet another object of this invention to provide a lightweight, waterproof safety barrier which can easily be installed around the perimeter of a pool to prevent the unauthorized use or entry into the pool.

And yet another object of this invention is to provide a lightweight, yet sturdy barrier to prevent access to a swimming pool or the like.

In accordance with these and other objects which will be apparent hereinafter, the instant invention will now be described with particular reference to the accompanying drawings.

DESCRIPTION OF THE PREFERRED EMBODIMENT

Figure 1:
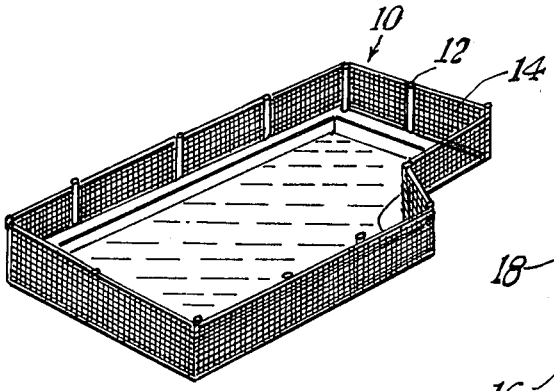
FIG. 1 is a perspective view of the invention disposed about the perimeter of a pool.

Referring now to the drawings and particularly FIG. 1, the present invention is shown generally at 10 and comprises a plurality of vertical support members 12 with a restraining panel 14 therebetween.

Figure 2:
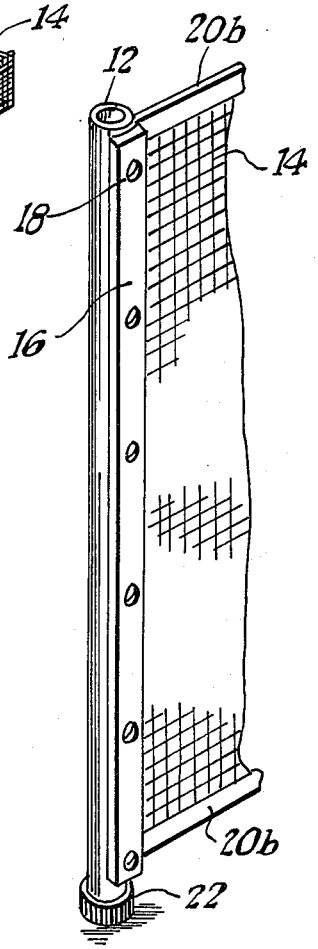
FIG. 2 is a fragmentary perspective view of a vertical support member and the panel termination in accordance with the present invention.
Figure 3:
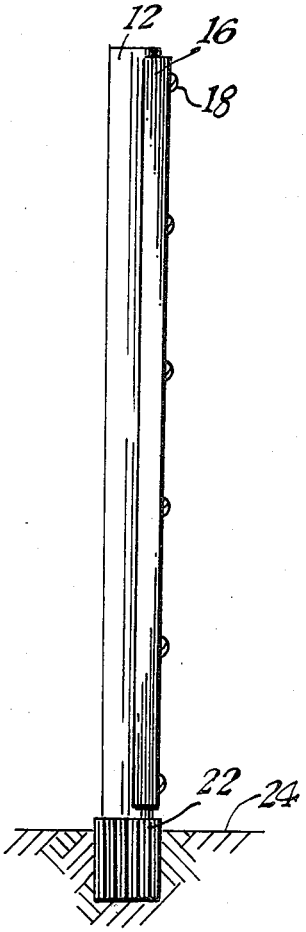
FIG. 3 is an end view of the invention shown mounted in the ground.
Figure 4:
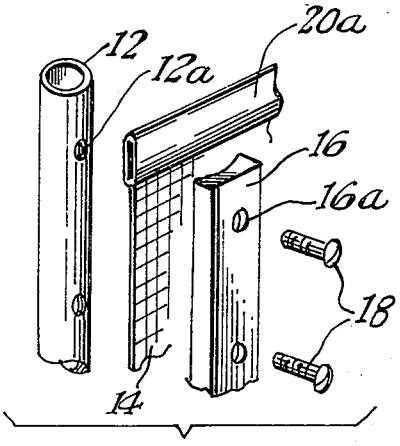
FIG. 4 is a partial exploded view of the panel connections in accordance with the present invention.
Figure 5:
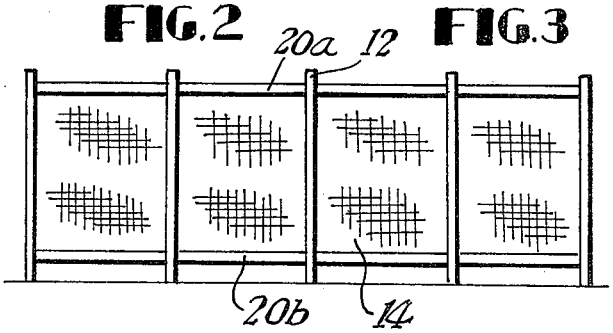
FIG. 5 is an elevational view of the invention.
Figure 6:
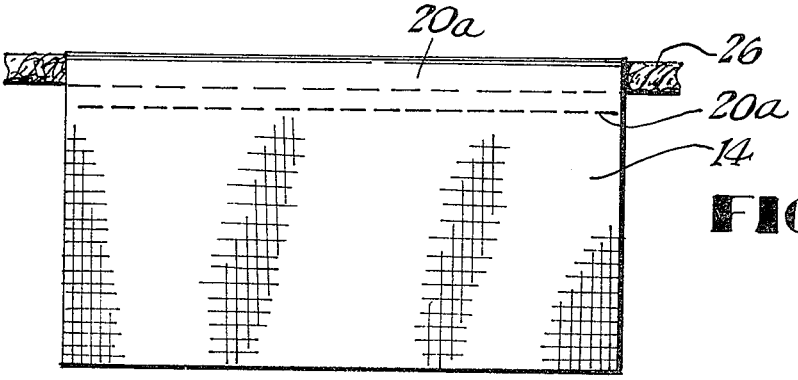
FIG. 6 is a partial front view of the invention, in elevation showing the supporting line.

Referring now to FIGS. 2, 3 and 4, the restraining panel 14 is shown connected to the vertical support member 12 by way of a connecting bracket 16 mounted over the restraining panel 14 and fastened into the support member 12 by way of the threaded fasteners 18 through apertures **16*a* and 12*a*. The restraining panel 14 also includes a vinyl reinforcing strip 20*a* on the top edge and 20*b* on the bottom edge of the restraining panel 14 to increase the strength of the panel. The reinforcing strips 20*a* and 20*b* are stitched together around the respective edges by the stitching 20*c* as shown in FIG. 6**.

Once the total length of the safety barrier is determined, a plurality of sleeves 22 are placed in the surface of the patio (preferably at 2 foot intervals) adjacent the pool in order to retain the ends of the vertical support members 12. Once the sleeves 22 are in place, a vertical support member is placed in each sleeve and the safety barrier is held in the upright position to prevent the entrance into the pool of any unauthorized person (especially small children not yet possessing the swimming skills necessary to engage in unsupervised swimming).

However, when it is desired to use the pool, the safety barrier may be simply removed by lifting the vertical support members 12 out of their respective sleeves 22 and folding the safety barrier into a storable disposition and transported away from the pool.

In the preferred embodiment, the vertical support member 12 and the connecting bracket 16 is made of aluminum, while the screws 18 are made of stainless steel. This insures a rust-free life of the safety barrier in spite of the fact that it is maintained in a position near water for its lifetime. The restraining panel 14 is preferably constructed of polycoated weather resistant nylon in a screen pattern as illustrated, while the reinforcing strips 20*b* are constructed of any vinyl, well known in the art. The top edge of the restraining panel is further reinforced by a nylon rope 26 on the inside of the reinforcing strip, that supports the panels and makes the barrier more difficult to penetrate. The panels are formed in ten foot strips in the preferred embodiment, but could be made in any suitable continuous lengths.

The instant invention has been shown and described herein in what is considered to be the most practical and preferred embodiment. It is recognized, however, that departures may be made therefrom within the scope of the invention and that obvious modifications will occur to a person skilled in the art.

I claim:

1. A lightweight, waterproof safety barrier comprising:

a plurality of spaced apart, rigid vertical support members;

at least one mesh, flexible, waterproof restraining panel;

means for connecting said panel to each of said vertical support members; and a flexible line connected to the top of said panel;

each said vertical support means includes an aluminum mounting bracket and at least one stainless steel screw mounted to a respective said vertical support member, holding said restraining panel therebetween;

each said vertical support member being constructed of aluminum.

2. A lightweight, waterproof safety barrier as set forth in claim 1, wherein:

said restraining panel is constructed of weather-resistant poly-coated nylon.

3. A lightweight, waterproof fence as set forth in claim 2, wherein:

said restraining panel includes a reinforcing strip along at least one of its edges.

4. A lightweight, waterproof safety barrier as set forth in claim 3, wherein:

said reinforcing strip along the top edge of said restraining panel includes a rope encased in strip.

* * * * *